US006359639B1

(12) United States Patent
Kitta et al.

(10) Patent No.: US 6,359,639 B1
(45) Date of Patent: Mar. 19, 2002

(54) THERMAL HEAD DRIVING INTEGRATED CIRCUIT

(75) Inventors: Tatsuya Kitta; Yoshihide Kanakubo; Yasuhiro Moya; Kazutoshi Ishii; Sumitaka Gotou, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/428,901

(22) Filed: Oct. 28, 1999

(30) Foreign Application Priority Data

Oct. 29, 1998 (JP) ..... 10-308834
Mar. 15, 1999 (JP) ..... 11-068033

(51) Int. Cl.[7] ..... B41J 2/345
(52) U.S. Cl. ..... 347/211
(58) Field of Search ..... 347/200, 206, 347/208, 209–210, 211

(56) References Cited

U.S. PATENT DOCUMENTS 4,704,614 A * 11/1987 Nakamura ..... 347/172
5,786,839 A * 7/1998 Itoh ..... 347/211

* cited by examiner

*Primary Examiner*—N. Le
*Assistant Examiner*—K. Feggins
(74) *Attorney, Agent, or Firm*—Adams & Wilks

(57) ABSTRACT

A thermal head driving integrated circuit capable of preventing the lowering of data transfer speed, and in which the number of bonding pads can be reduced as well as current consumption has a driver circuit in which at least two shift registers are series-arranged in front and rear stages to sequentially transfer print data in a serial signal manner to be read out in a batch mode to drive a plurality of heating resistive elements. A switch circuit is interposed between an output terminal of the front-staged shift register and an input terminal of the rear-staged shift register to selectively connect and disconnect the two shift registers.

20 Claims, 10 Drawing Sheets

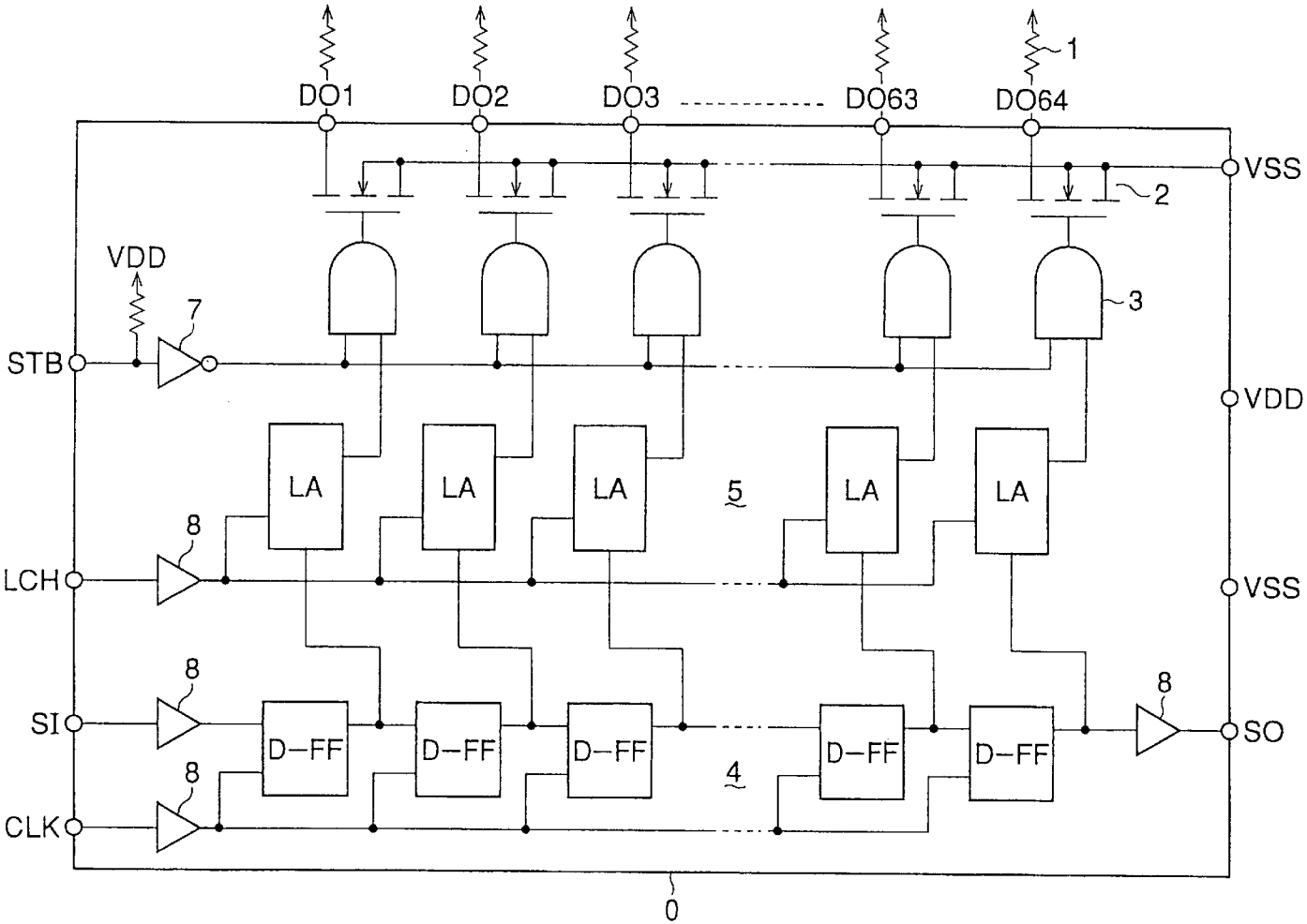
PRIOR ART Fig.11

THERMAL HEAD DRIVING INTEGRATED CIRCUIT

BACKGROUND OF THE INVENTION

The present invention is related to a thermal head driving integrated circuit (IC) for entering thereinto a data signal to control energizing of a heating resistive element.

Referring now to FIG. 11, an example of a conventional thermal head driving IC will be briefly explained. Such a thermal head driving integrated circuit is disclosed in, for instance, Japanese Patent Application Laid-Open No. Hei 3-53950. As shown in this drawing, the thermal head driving IC 0 controls energizing of a plurality of heating resistive elements 1, and is equipped with the output terminals DO1 to DO64 connected to the respective heating resistive elements 1. As a result, in this example, the thermal head driving IC 0 can drive 64 of these heating resistive elements 1 at a time. One terminal of the respective heating resistive elements 1 are commonly connected to each other, to which the energizing power supply voltage (for example, 24 V) is applied. The other terminal of the respective hearing resistive elements 1 are connected via the output terminals to drive transistors 2. The drive transistors 2 constitute a driver, and are composed of the N-channel type MOS transistors, in this example. Each of the drive transistors 2 is an open drain output, and all of the sources of these drive transistors 2 are connected to a ground potential VSS. The output terminal of an AND gate circuit 3 is connected to the gate of each drive transistor 2.

Reference numeral 4 shows a shift register for sequentially storing thereinto 1-line data, and is arranged with a series-connection of D-FFs. The shift register 4 is connected via a buffer 8 to a data input terminal SI. Also, the final stage of the shift register 4 is connected via the buffer 8 to a data output terminal SO. In addition, a clock signal is supplied from a control terminal CLK via the buffer 8 to the D-FFs of the respective stages of the shift register 4.

Reference numeral 5 shows a latch circuit for latching the data of the shift register 4 in a batch mode. A latch signal is supplied from a control terminal LCH via the buffer 8. The outputs of the respective stages of the latch circuit 5 are connected to one input terminal of the corresponding AND gate circuit 3. The other input terminals of the respective AND gate circuits 3 are commonly connected to the output terminal of an inverter 7. A strobe signal is applied via a control terminal STB to the input terminal of the inverter 7. It should be noted that the power supply voltage VDD is applied to this thermal head driving IC 0. The input terminal of the inverter 7 is connected via the pull-up resistor to the VDD.

The shift register 4 reads the data signal inputted into the data input terminal SI at the rising edge of the clock signal applied to the control terminal CLK. When the control terminal LCH is at the L-level, the latch circuit 5 latches the data stored in the respective stages of the shift register 4 in the batch mode. When the control terminal LCH is at the H-level, this latch circuit 5 holds the data latched immediately before this control terminal LCH becomes the H level. The data latched in the latch circuit 5 is outputted via the AND gate circuit 3 to the corresponding drive transistor 2 when the control terminal STB is at the L-level.

In other words, when the control terminal STB is at the L-level and the data outputted from the latch circuit 5 is at the H-level, the drive transistor 2 is turned ON, and thus, the corresponding heating resistive element 1 is energized. Conversely, when the control terminal STB is at the L-level and the data is at the L-level, the drive transistor 2 is turned OFF.

When the control terminal STB is set to the H-level, all of the drive transistors 2 are turned OFF irrespective of the output of the latch circuit 5.

SUMMARY OF THE INVENTION

For example, when a print operation is carried out on a sheet of paper having a size of A4 in a line sequential manner, 1,728 of the heating resistive elements 1 are arranged in one column. To drive these 1,728 dots of heating resistive elements, 27 of the thermal head driving ICs 0 having 64 driver output terminals need be mounted in one column on a circuit board. In order to reduce the total number of these thermal head driving IC approximately ½, for example, as represented in FIG. 3, such a thermal head driving IC 0 has been developed, in which two stages of shift registers 41 and 42 are built in a series manner. Each of the shift registers 41 and 42 has 64 output stages. As an entire circuit, this IC 0 has 64 2=128 driver output terminals. As a result, the total number of the packaged ICs can be reduced by ½, as compared with that of the ICs indicated in FIG. 11. The front-staged shift register 41 is provided with the data input terminal SI1 and the data output terminal SO1, and also, the rear-staged shift register 2 is equipped with the data input terminal SI2 and the data output terminal SO2.

As a consequence, the operation of the IC itself is similar to that of the IC shown in the drawing. Since both the shift registers 41 and 42 are used in a parallel manner, one set of 64 pieces of data can be written into the respective shift registers 41 and 42 at the same time.

On the other hand, in the IC shown in FIG. 3, when specifically no highspeed printing operation is required, the output terminal SO1 of the front-staged shift register 41 and the input terminal SI2 of the rear-staged shift register 42 are commonly connected to each other by way of a wire bonding and the like, so that both the shift registers 41 and 42 may be used in the series manner. In this case, while the data are entered from the terminal SI1, 128 pieces of such data are sequentially written into the series-connection between the shift register 41 and the shift register 42. In this manner, the total number of input data (namely, the number of input lines of data) with respect to the ICs arranged in one column can be reduced by ½. However, since the intermediate input/output terminals SO1 and SI2 must be connected by way of the wire bonding, there is a demerit in view of cost. Also, since the stray capacitance $C_p$ is produced at the wire bonding portion, it could not avoid such a problem that the data transfer speed between the shift registers 41 and 42 is lowered.

Thus, it is conceivable that a switch circuit is employed which may internally connect/disconnect both the output terminal SO1 of the front-staged shift register 41 and the input terminal SI2 of the rear-staged shift register 42, so that both the shift registers 41 and 42 may be switched in the series use mode and the parallel use mode while preventing an occurrence of a stray capacitance.

In such a case that the series use mode and the parallel use mode are switched by employing such a switch circuit, when the output terminal SO1 and the input terminal SI2 are provided, the total number of input/output pads is increased, so that an IC chip will become bulky and also the total number of bondings will be increased.

However, in the case that both the shift registers 41 and 42 are connected so as to be used in the series manner, both the output terminal SO1 of the front-staged shift register 41 and the input terminal SI2 of the rear-staged shift register 41 and the input terminal SI2 of the rear-staged shift register 42 are used. Also, in the case that both the shift registers 41 and 42 are disconnected from each other so as to be used in the parallel manner, although the input terminal SI2 of the rear-staged shift register 42 is used, the output terminal SO1 of the front-stage shift register 41 is not always used. There is another case that tests are separately carried out as to whether or not both the shift registers 41 and 42 are operated under normal condition. In this case, the output terminal SO1 of the shift register 41 and the input terminal SI2 of the shift register 42 are used. However, both the shift registers 41 and 42 may be separately tested, and both the output terminals SO1 and the input terminal SI2 need not be used at the same time.

In other words, when both the shift registers 41 and 42 are mounted on a single semiconductor chip, while the pads of the output terminal SO1 of the front-staged shift register 41 and the pads of the input terminal SI2 of the rear-staged shift register 42 are commonly used, these pads may be selectively used as pads of either terminal of either register.

Also, in the case that the switch circuit is provided between both the shift registers 41 and 42 so as to use these shift registers in the series manner, the input terminal SI2 of the rear-staged shift register 42 which is not used is required to be connected to either the power supply VDD or the ground potential VSS (namely, is fixed to either HIGH or LOW) in order to prevent floating (occurrence of penetration current). Then, when the pads of the output terminal SO1 and the pads of the input terminal SI2 are commonly used, these shift registers must be similarly arranged to prevent floating.

Also, as indicated in FIG. 11, the input terminal SI and the output terminal SO are connected via the buffer circuit 8 to the shift register 4. Normally, in the buffer circuit 8 connected so as to increase the output, plural stages of inverters and buffers are connected in a series manner as a gate group capable of gradually increasing the output. As a result, the electric power consumed in the respective stages is increased. In particular, when the switch circuit is provided between the shift registers 41 and 42 so as to use these shift registers in the series manner, the buffer circuit 8 connected to the output terminals SO1 and SI2 which are not used consumes useless electric power.

Furthermore, the following circuit arrangement may be generally conceived when both the shift registers 41 and 42 having the same structures are mounted on a single semiconductor chip in view of an element arranging efficiency. That is, D-FFs are continuously arranged by adjoining both the shift registers to each other. As a result, in general, when the switch circuit for connecting/disconnecting both the shift registers 41 and 42 is further mounted on the semiconductor chip, this switch circuit may be arranged on the side of the edge portions of both the shift registers 41 and 42 which are continuously arranged. However, when the switch circuit is arranged at the edge portion, the wiring distance between the series-connected shift registers 41 and 42 becomes long, so that the data transfer speed between the shift registers 41 and 42 is delayed.

Also, when the output terminal SO1 and the input terminal SI2 are also arranged at the edge portion in connection with the arranging position of the switch circuit at the edge portion, the wiring length of the input terminal SI2 of the rear-stages shift register 42 becomes longer than the wiring length of the input terminal SI1 of the front-staged shift register 41. Thus, there are some possibilities that the signal timing such as the set-up time "stu" and the hold time "the" may differ, depending upon both the shift registers.

To solve the above-explained problems of the prior art, the following means are employed. That is to say, a thermal head driving integrated circuit, according to the present invention, is basically to control energizing of a heating resistive elements in response to a data signal. This thermal head driving integrated circuit is provided with a driver in which at least two stages of shift registers are series-arranged in front and rear stages, the two-staged shift registers sequentially transfer data signals supplied thereto in a serial signal manner to store thereinto the transferred data signals, and the stored data signals are read out in a batch mode so as to drive a plurality of heating resistive elements. This thermal head driving integrated circuit employs switch means interposed between an input terminal and output terminal of the data signal with respect to the front-staged shift register, interposed between an input terminal and output terminal of the data signal with respect to the rear-staged shift register, and interposed between the output terminal of the front-staged shift register and the input terminal of the rear-staged shift register. As a featured aspect, the switch means selectively connect and disconnect the front-staged shift register and the rear-staged shift register series-connected to and from each other.

Preferably, the shift registers, the driver, and the switch means are formed on a semiconductor chip having an elongated shape in an integrated circuit form. In this case, the output terminals of driver side thereof, which are connected to the externally provided respective heating resistive elements are arranged along one long edge side of the semiconductor chip. Also, the input terminal of the data signal, the output terminal thereof, a power supply terminal, and a ground terminal, and also other control terminals are arranged along the other long edge side of the semiconductor chip. Preferably, the output terminals of the driver side are arranged in a staggered manner. Alternatively, the ground terminals are arranged in an array shape along a center of the semiconductor chip.

In such a case that a relatively high-speed printing operation is required, the front-staged shift register is separated or disconnected from the rear-staged shift register by way of the above-explained switch means, and the data signal is entered into the front-staged shift register and the rear-staged shift register at the same time. As a result, the transfer efficiency of the data signal is improved. On the other hand, when a relatively slow-speed printing operation is sufficient, the front-staged shift register and the rear-staged shift register are connected in series by employing the switch means. As a result, the input series of the data signals can be reduced by ½, in view of the overall thermal head. In addition, since the switch means internally connects the front-staged shift register and the rear-staged shift register with each other, this switch means can suppress the stray capacitance which may give the adverse influence to the data transfer speed, and furthermore, can reduce the total number of processing steps required for the wire bonding work of the prior art.

Also, a thermal head driving integrated circuit, according to the present invention, is to control energizing of a heating resistive element in response to a data signal. The thermal head driving integrated circuit is provided with a driver in which at least two stages of shift registers are series-arranged in front and rear stages, the two-staged shift registers sequentially transfer data signals supplied thereto in a serial signal manner to store thereinto the transferred data signals, and the stored data signals are read out in a batch mode so as to drive a plurality of heating resistive elements. Then, the thermal head driving integrated circuit is equipped with an input terminal of the data signal with respect to the front-staged shift register, an output terminal of the data signal with respect to the rear-staged shift register, and switch means interposed between an output unit of the front-staged shift register and an input unit of the rear-staged shift register, for selectively connecting and disconnecting the shift registers series-arranged in the front and rear stages to and from each other. Furthermore, this thermal head driving integrated circuit is provided with a common terminal into or from which the data signal is inputted or outputted, and selecting means for selectively connecting the common terminal with any one of the output unit of the front-staged shift register and the input unit of the rear-staged shift register.

Preferably, the switch means and the selecting means are mutually operated in conjunction with each other, and in the case that the switch means connects the front-staged shift register and the rear-staged shift register in series, the selecting means connects the output unit of the front-staged shift register to the common terminal. Preferably, the switch means and the selecting means are arranged by either a tri-state buffer or a tri-state inverter.

In accordance with the present invention, the output terminal of the front-staged shift register and the input terminal of the rear-staged shift register are not separately provided, but one common terminal is switched by the switch means so as to be commonly used. As a result, the total number of terminals can be reduced. The semiconductor chip can be made compact. Also, since the total number of bondings is reduced, the quality can be improved.

Also, a thermal head driving integrated circuit, according to the present invention, is to control energizing of a heating resistive element in response to a data signal. The thermal head driving integrated circuit is provided with one stage, or two stages of shift registers series-arranged in front and rear stages, for sequentially transferring data signals supplied thereto in a serial signal manner to store thereinto the transferred data signals; a driver for reading out the data signals stored in the shift registers in a batch mode so as to drive a plurality of heating resistive elements; and also an input terminal and output terminal of the data signal with respect to each stage of the shift registers. As a featured aspect, this thermal head driving integrated circuit is provided with connecting/disconnecting means for disconnecting a buffer circuit from a power supply, the buffer circuit being connected to a terminal which is not used in some cases out of the input terminal and the output terminal. Preferably, the connecting/disconnecting means is arranged by either a tri-state buffer or a tri-state inverter.

In accordance with the present invention, since the buffer circuit can be disconnected from the buffer circuit and this buffer circuit is connected to such an unused terminal as the output terminal of the front-staged shift register and also the input terminal of the rear-staged shift register in the case that, for example, two stages of shift registers are series-connected, the power consumption of this buffer circuit can be suppressed while this buffer circuit is not used.

Also, the thermal head driving integrated circuit, according to the present invention, includes either the switch means or the switch means and the selecting means which are arranged between the front-staged shift register and the rear-staged shift register.

Since the switch means is arranged between both the shift registers, the wiring distance when both the shift registers are series-connected can be shortened, it is possible to avoid a delay occurred in the data transfer speed between these shift registers.

Since the switch means is arranged at an intermediate portion between both the shift registers, the input terminal of the rear-staged shift register can be positioned in the vicinity of the rear-staged shift register, and the wiring distances of both the input terminals of the shift registers can be made substantially equal to each other. Also, since the selecting means is also arranged between both the shift registers, the wiring distances of both the input terminals of the shift registers can be made substantially equal to each other. Also, since the wiring distances of the input terminals can be made substantially equal to each other, the signal timing can be made equal to each other, so that the characteristic of the thermal head with respect to the high speed printing operation can be improved.

BRIEF DESCRIPTION OF THE DRAWINGS

FIG. 7(*c*) is a circuit diagram for showing an example of a tri-state inverter used therein according to the embodiment.

FIG. 11 is a circuit diagram for showing another example of conventional thermal head driving integrated circuits.

DESCRIPTION OF THE PREFERRED EMBODIMENTS

Figure 1:
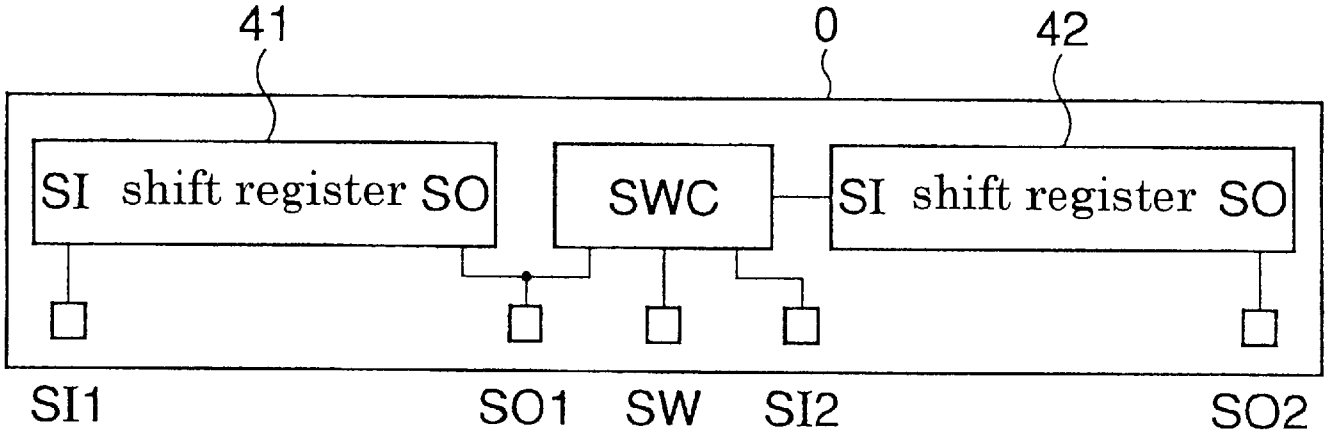
FIG. 1(*a*) and FIG. 1(*b*) is a block diagram for showing a basic arrangement of a thermal head driving integrated circuit according to the present invention.
Figure 1:
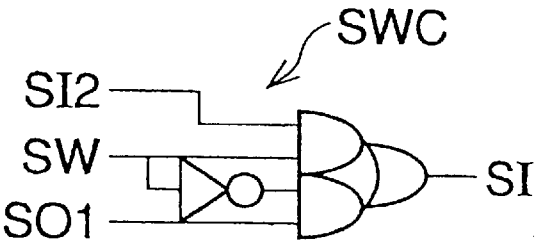

Referring now to the drawings, an embodiment mode of the present invention will be described in detail.

FIG. 1(*a*) is a schematic diagram for showing a basic arrangement of a thermal head driving integrated circuit according to this embodiment mode. This thermal head driving integrated circuit 0 is basically employed so as to control energizing of a heating resistive element (not shown) in response to a data signal. In this integrated circuit 0, at least two stages of shift registers 41 and 24 are series-arranged in front and rear stages, and these shift registers 41 and 42 sequentially transfer a data signal supplied in a serial manner and store thereinto the transferred data signal. It should be noted that the total number of the shift registers is not limited to 2, but may be selected to be 3 or more. Also similar to FIG. 11, the thermal head driving integrated circuit is equipped with a driver (not shown) for reading out the data signals saved in the respective shift registers 41 and 42 to drive a plurality of heating resistive elements.

The front-staged shift register 41 has an input terminal SI1 of a data signal and an output terminal SO2 of a data signal. Also the rear-staged shift register 42 has an input terminal SI2 of a data signal and an output terminal SO2 of a data signal. As a featured aspect, a switch circuit SWC which constitutes switch means is interposed between the output terminal SO1 of the front-staged shift register 41 and the input terminal SI2 of the rear-staged shift register 42. This switch circuit SWC may selectively connect/disconnect the front-staged shift register and the rear-staged shift register series-arranged with each other.

In the example shown in FIG. 1(*a*), while a potential is externally applied to a control terminal SW, connecting/disconnecting of the switch circuit SWC is controlled. A concrete structural example of the switch circuit SWC is indicated in FIG. 1(*b*). In this concrete example, when the control terminal SW is at an L (low)-level, the output terminal SO of the front-staged shift register 41 is connected to the input terminal SI of the rear-staged shift register 42. In other words, the front-staged shift register 41 and the rear-staged shift register 42 are series-connected to each other. On the other hand, when the control terminal SW is at an H (high)-level, the input terminal SI2 for the rear-staged shift register 42 is connected to the input terminal SI2 of the rear-staged shift register 42. As a result, the front-staged shift register 41 is separated or disconnected from the rear-staged shift register 42.

Figure 2:
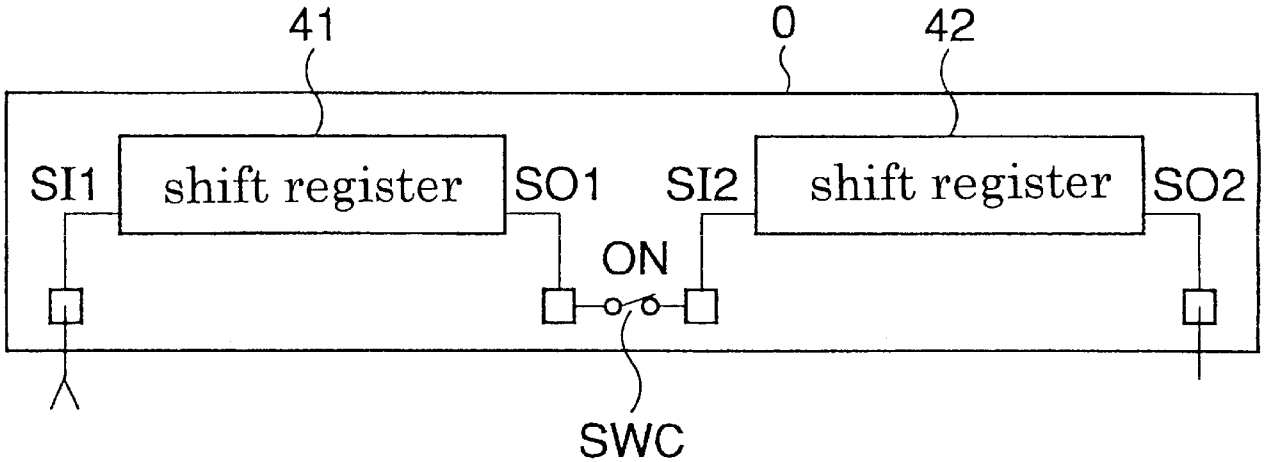
FIG. 2(*a*) and FIG. 2(*b*) is a block diagram for explaining operation of the thermal head driving integrated circuit shown in FIG. 1.
Figure 2:
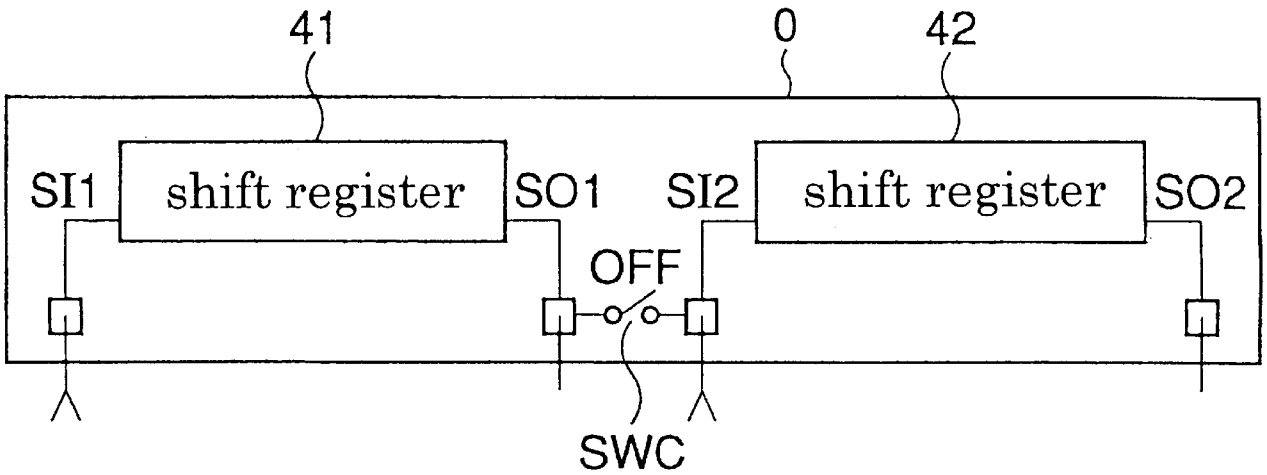
Figure 3:
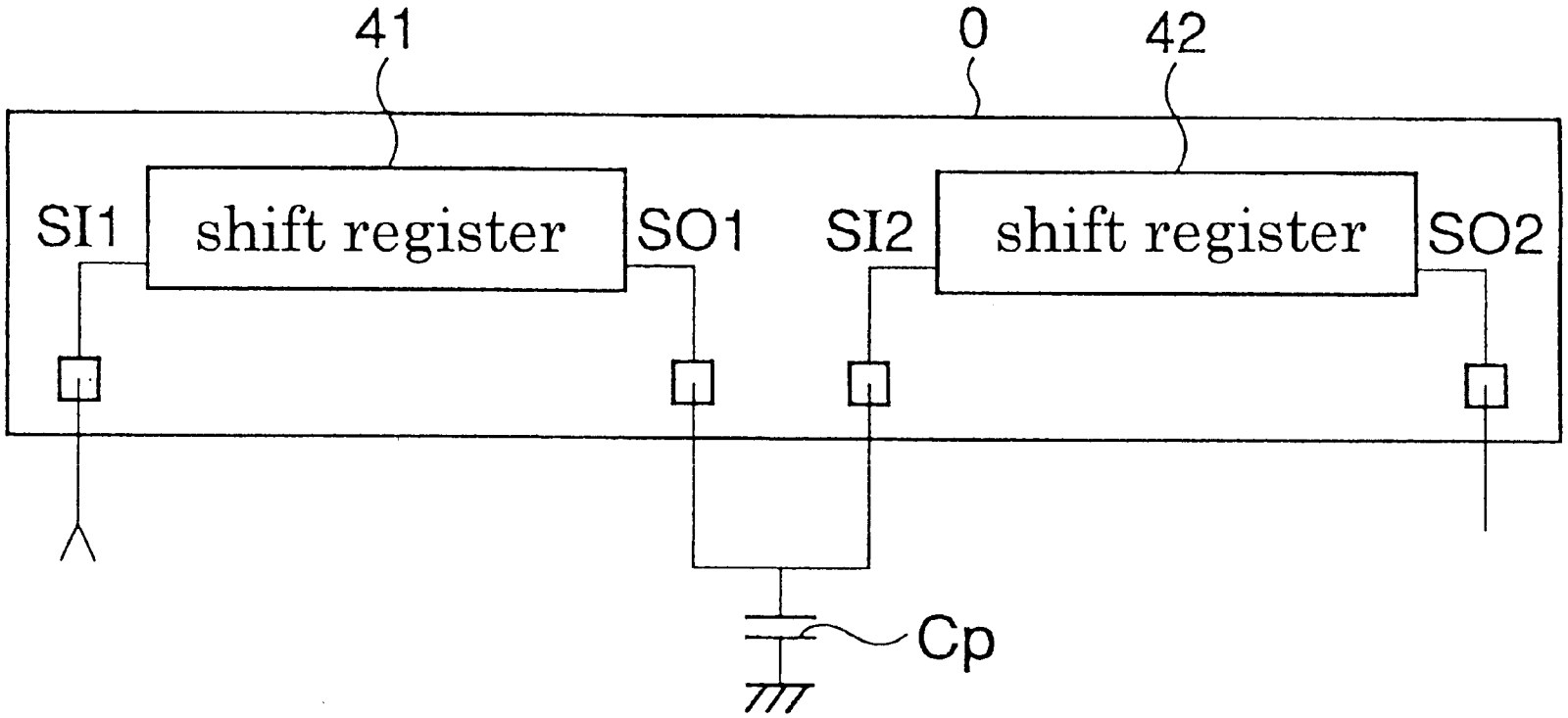
PRIOR ART Fig.3
FIG. 3 is a block diagram for indicating one example of conventional thermal head driving integrated circuits.

FIG. 2 is a schematic diagram for representing an operating state of the thermal head driving circuit 0 shown in FIG. 1(*a*). FIG. 2(*a*) shows such a state that the front-staged shift register 41 and the rear-staged shift register 42 are series-connected to each other by the switch circuit SWC in an equivalent manner. In this case, a data signal is supplied from the input terminal SI1 with respect to the front-staged shift register 41 to the thermal head driving integrated circuit 0, and then, is transferred via the switch circuit SWC to the rear-staged shift register 42. Since the output terminal SO1 of the front-staged shift register 41 is internally connected via the switch circuit SWC to the input terminal SI2 of the rear-staged shift register 42, no specific stray capacitance is produced, but also no adverse influence is given to the data transfer speed. Also, since the shift registers need not be externally connected by way of the wire bonding, the total number of manufacturing steps can be reduced.

FIG. 2(*b*) represents such a state that the switch circuit SWC is turned OFF in an equivalent manner, and both the front-staged shift register 41 and the rear-staged shift register 42 are separated or disconnected from each other. In this case, a data signal is supplied from the input terminal SI1 corresponding thereto to the front-staged shift register 41, and at the same time, the data signal is also supplied from the input terminal SI2 corresponding thereto to the rear-staged shift register 42. As a result, as compared with the connection mode shown in FIG. 2(*b*), the data transfer efficiency can be increased by a factor of 2 in the disconnection mode indicated in FIG. 2(B). Since the transfer time may become ½ in this disconnection mode, this thermal head driving integrated circuit is especially suitable for a video printer and an imaging thermal print head, which require high speed printing operations.

Figure 4:
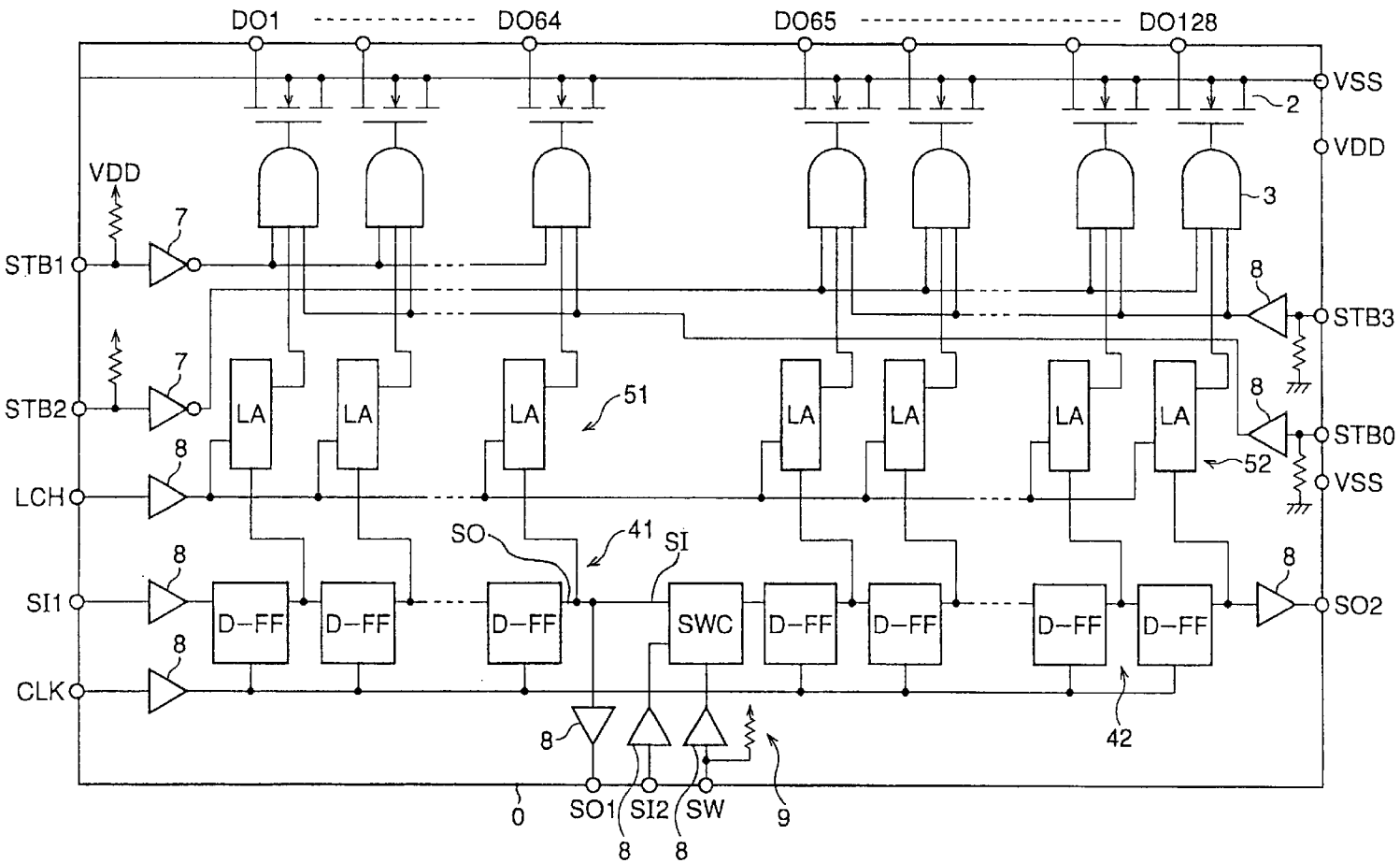
FIG. 4 is a circuit diagram for showing an example of the thermal head driving integrated circuit according to an embodiment of the present invention.

FIG. 4 is a block diagram for indicating an example of a thermal head driving integrated circuit according to this embodiment mode. For the sake of an easy understanding, the same reference numerals will be employed as those for denoting the corresponding circuit portions of the conventional thermal head driving integrated circuit shown in FIG. 11. As shown in this drawing, this thermal head driving integrated circuit 0 is formed on a semiconductor chip in an integrated circuit form. The thermal head driving integrated circuit is provided with driver output terminals DO1 to DO128; a power supply terminal VDD; a ground terminal VSS; data input terminals SI1 and SI2; data output terminals SO1 and SO2; and also various sorts of control terminals STB0, STB1, STB2, STB3, LCH, CLK, SW. Total 128 pieces of heating resistive elements (not shown) are connected to the driver output terminals DO1 to DO128. A drive transistor 2 is connected to each of these driver output terminals in an open-drain connection manner. A 3-output/1-input AND gate circuit 3 is connected to a gate of each of the drive transistor 2.

The control terminal STB1 is commonly connected via an inverter 7 to first input terminals of the 1st through the 64th AND gate circuit 3. On the other hand, first input terminals of the 65th through the 128th AND gate circuit 3 are commonly connected via the inverter 7 to another control terminal STB 2. These control terminals STB1 and STB2 are pulled up to the power supply voltage VDD.

Halves of the third input terminals of the 1st to the 128th AND gate circuits 3 are connected via the buffer 8 to both the control terminals STB0 and STB3, respectively. These control terminals STB0 AND STB3 are pulled down to the ground potential VSS.

Furthermore, all of the second input terminals of the 1st to the 128th AND gate circuits 3 are connected to the respective corresponding latch elements LAs of the latch circuit. It should be understood that this latch circuit is subdivided into a latch circuit 51 for constituting a front-stage unit and another latch circuit 52 for constituting a rear-stage unit. Each of the latch circuit 51 and the latch circuit 52 is constructed of 64 pieces of the latch elements LAs. Both the latch circuit 51 and the latch circuit 52 are commonly connected via the buffer 8 to the control terminal LCH.

Furthermore, this thermal head driving integrated circuit 0 is equipped with a front-staged shift register 41 and a rear-staged shift register 42. The front-staged shift register 41 is arranged by connecting 64 stages of D-FFs (Data-flip-flops), and is provided with a data input terminal SI1 and a data output terminal SO1. Similarly, the rear-staged shift register 42 is arranged by series-connecting 64 stages of D-FFs, and is provided with a data input terminal SI2 and a data output terminal SO2. It should be noted that the respective D-FFs are commonly connected via the buffer 8 to the control terminal CLK.

A switch circuit SWC is interposed between an output unit SO of the front-staged shift register 41 and an input unit SI of the rear-staged shift register 42. As the switch circuit SWC, for example, a switch circuit shown in FIG. 1(*b*) is used.

One input of this switch circuit SWC is connected via the buffer 8 and a pull-up resistor to the control terminal SW. Another input of the switch circuit SWC is connected to the output unit SO of the front-staged shift register 41, in the half way of which the output terminal SO1 is connected via the buffer 8. Still another input of this switch circuit SWC is connected via the buffer 8 to the input terminal SI2.

Furthermore, the output of the switch circuit SWC is connected to the input unit SI of the rear-staged shift register 42. Both the switch circuit SWC and the control terminal SW constitute switch means 9.

As previously explained, since the switch circuit is arranged between the output unit SO of the front-staged shift register 41 and the input unit SI of the rear-staged shift register, a physical distance defined from the input terminal SI1 to the input unit (namely, D-FF located at the frontmost stage) of the front-staged shift register can be made substantially equal to a wiring distance (physical distance) defined from the input terminal SI2 via the switch circuit SWC to the input unit SI (D-FF located at the frontmost stage) of the rear-staged shift register. As a consequence, in such a case that both the shift registers 41 and 42 are disconnected from each other by the switch circuit SWC to be used in the parallel mode, the timing (set-up time "tsu," hold time "th," etc.) of the respective input signals to the shift register 41 and 42 can be set to equal values. Therefore, the characteristic of the thermal head with respect to the high-speed printing operation can be improved.

It should be understood that the above-described effect is such an effect achieved by making a physical distance L1 substantially equal to another physical distance L2. The physical distance L1 is defined from the input terminal SI1 up to the input unit of the front-staged shift register. The physical distance L2 is defined from the input terminal SI2 via the switch circuit SWC to the input unit SI of the rear-staged shift register. As a consequence, both the shift registers 41 and 42 may be continuously arranged so as to increase the manufacturing efficiency of the circuit, and also, both the switch circuit SWC and the input terminal SI1 may be arranged in such a location that the physical distances L1 and L2 are made substantially equal to each other. For example, the switch circuit SWC is arranged on the side of the further rear stage of the rear-staged shift register 42, and the input terminal SI1 is arranged at a substantially intermediate position between the shift registers 41 and 42.

Subsequently, a description will now be made of operations of this thermal head driving integrated circuit 0 with reference to FIG. 4. When the control terminal SW is at an L-level, the front-staged shift register 41 is series-connected via the switch circuit SWC to the rear-staged shift register 42. In this case, in response to a rising edge of a clock signal applied to the control terminal CLK, the front-staged shift register 41 sequentially reads thereinto data entered to the data input terminal SI, and then transfers 128-dot data to the rear-staged shift register 42. Conversely, when the control terminal SW is at an H-level, or is opened, the front-staged shift register 41 is separated or disconnected from the rear-staged shift register 42. In this case, the front-staged shift register 41 reads thereinto 64-dot data entered in the data input terminal SI1 in response to a rising edge of a clock signal. At the same time, the rear-staged shift register 42 reads thereinto 64-dot data entered in the data input terminal SI2.

When the control terminal LCH is an L-level, the latch circuits 51 and 52 read thereinto the data saved in the shift registers 41 and 42. Conversely, when the control terminal LCH is an H-level, the latch circuits 51 and 52 hold the data which have been latched immediately before. In such a case that both the control terminals STB1 and STB2 are at L-levels and furthermore both the control terminals STB0 and STB3 are at H-levels, the 128-dot data latched in both the latch circuits 51 and 52 are outputted via the AND GATE circuit 3 to the respective drive transistors 2. When the data outputted from the AND gate circuit 3 are at H-levels, the drive transistors 2 are turned ON to energize the corresponding heating resistive elements. Conversely, when the output data are at L-levels, the drive transistors 2 are turned OFF. In the case that either both the control terminals STB1 and STB2 are set to the H-levels or both the control terminals STB0 and STB3 are set to the L-levels, all of the drive transistors 2 are turned OFF.

As previously explained, this thermal head driving integrated circuit 0 contains the 128-bit (64×2) shift registers and the latch circuits. The frequency of the clock signal applied to the control terminal CLK is higher than, or equal to 10 MHz at maximum, namely high speeds. Since the shift registers 41 and 42 may be divided by ½ in the unit of 64 bits, this thermal head driving integrated circuit is suitable for a thermal print head for a video printer, and a thermal print head for an image. Conversely, when a high-speed printing operation is not specifically required, both the shift registers 41 and 42 may be divided by 1/1 in the unit of 128 bits. As a result, the input signal series of the data signals may be reduced. In this case, since the front-staged shift register 41 and the rear-staged shift register 42 are internally connected to each other, the data transfer speed is not essentially lowered.

Figure 5:
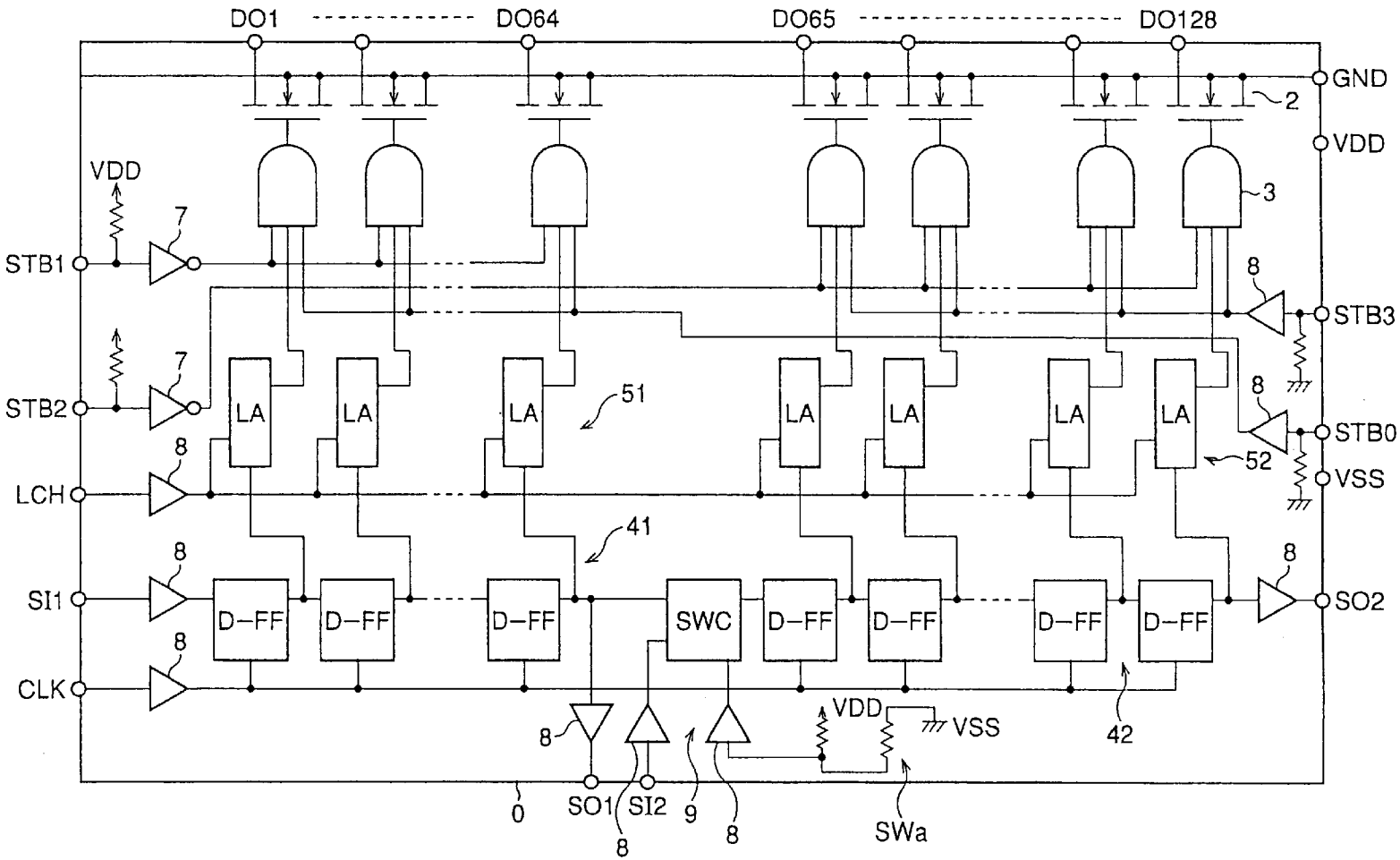
FIG. 5 is a circuit diagram for showing another example of the thermal head driving integrated circuit according to the embodiment of the present invention.

FIG. 5 is a schematic block diagram for showing another example of the thermal head driving integrated circuit according to this embodiment of the present invention. It should be understood that for the sake of an easy understanding, the same reference numerals of the example shown in FIG. 4 will be employed as those for indicating the same, or similar circuit portions of this thermal head driving integrated circuit. A different point of this example is that a fuse trimming structure SWa is employed instead of the terminal SW used to externally control the switch circuit SWC. The control terminal of the switch circuit SWC is internally connected via a buffer 8 to any one of a VDD and a VSS. To select any one of the VDD and the VSS, a so-called "fuse trimming", or a so-termed "laser trimming" is employed. In a certain case, any one of the VDD and the VSS may be selected by way of a mask option at a semiconductor manufacturing process stage, instead of these trimming methods.

Figure 6:
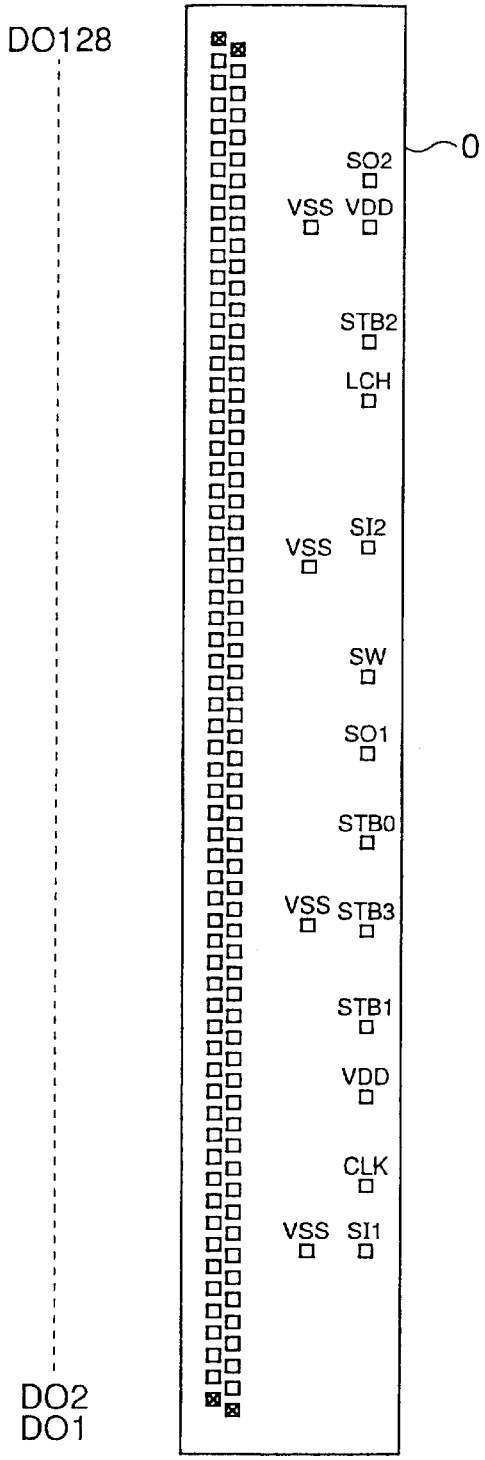
FIG. 6 is a plan view for indicating a concrete shape of the thermal head driving integrated circuit according to the present invention.

Next, FIG. 6 shows a concrete shape of this thermal head driving integrated circuit. As indicated in this drawing, in this thermal head driving integrated circuit 0, shift registers, drivers, switch means, and the like are formed on a semiconductor chip having an elongated shape in an integrated circuit form. The output terminals DO1 to DO128 are arranged along one long edge of this semiconductor chip, and are provided on the side of these drivers which are connected to the externally provided heating resistive elements. In contrast, the input terminals SI1 and SI2 for the data signal and the output terminals SO1 and SO2 for the data signal; the power supply terminal VDD and the ground terminal VSS; and other control terminals STB0, STB1, STB2, LCH, CLK, and SW are arranged along the other long edge of the semiconductor chip. With employed of the above-described structure, in such a case that a plurality of semiconductor chip are mounted on a circuit board in one column, wiring patterns may be readily designed. It should also be noted that since the output terminals DO1 to DO128 are arranged in a staggered manner, the wire bonding mounting density may be increased. Also, since the ground terminal VSS is arranged at a substantially center portion of a semiconductor chip, the ground potentials may be uniformly applied to the respective transistors.

Next, another embodiment mode of the present invention will now be explained.

In this embodiment mode, the thermal head driving integrated circuit 0 is arranged in such a manner that the buffer 8 is disconnected from the power supply voltage VDD, this buffer 8 which is connected to a terminal which is not used in some cases out of the input terminal and the output terminal. As a result, the consumed current of this buffer which is connected to the unused terminal can be suppressed.

This is, in this embodiment mode, the buffer 8 is constituted by either a tri-state buffer or a tri-state inverter (either clocked buffer or clocked inverter). Then, when the input terminal, or the output terminal is not used, while the tri-state inverter and the like are brought into a high impedance state, this tri-state inverter is disconnected form the power supply voltage VDD. As a result, the current consumed by the buffer 8 can be eliminated.

Figure 7:
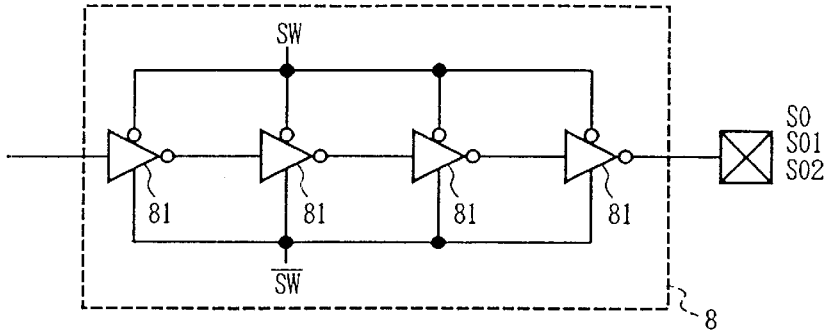
FIG. 7(*a*) and FIG. 7(*b*) are circuit diagrams for indicating an example of buffers employed in the thermal head driving integrate circuit according to the embodiment of the present invention.
Figure 7:
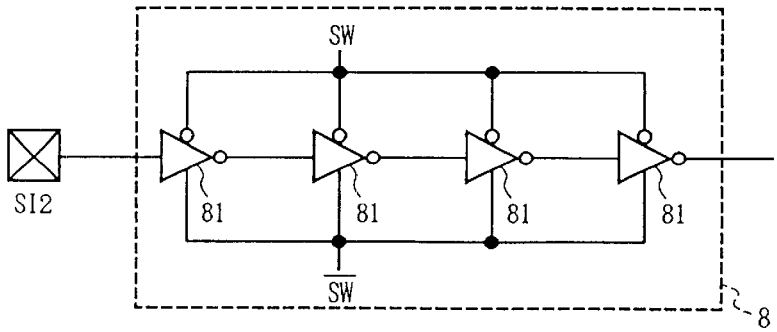
Figure 7:
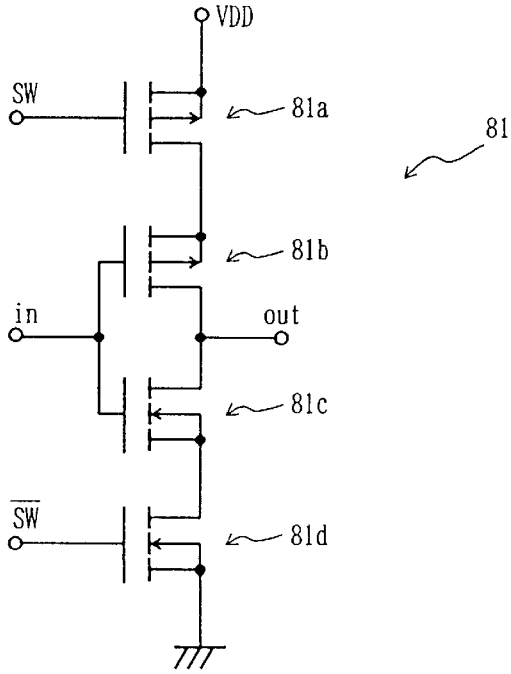

FIG. 7 shows the buffers 8, the input terminal, and the output terminal.

As indicated in this FIG. 7(*a*), the buffer according to this embodiment mode may be applied to the buffer 8 which is connected to the output terminals SO1 and SO2 shown in FIG. 1, and the output terminal SO indicated in FIG. 11. In the buffer 8 of this embodiment mode, 4 sets of tri-state inverters 81 are series-connected to each other. The output from the last-staged tri-state inverter 81 is connected to a pad of the output terminal SO and the like. The input of the first-staged tri-state buffer 81 is connected to either the shift registers 41, 42, or the output of the final-staged D-FF.

As shown in FIG. 7(*b*), the buffer 8 according to this embodiment mode may also be applied to the buffer 8 connected to the input terminal SI2 shown in FIG. 1. Also, in this case of the buffer 8, 4 sets of tri-state buffers 81 are series-connected to each other. The input of the first-staged tri-state buffer 81 is connected to a pad of the input terminal SI2. The output of the last-staged one is connected to the input of the first-staged D-FF of the rear-staged shift register 42.

It should also be noted that the total number of the tri-state inverters 81 need not be selected to be 4, but may be selected to be 1, 2, 3, 5, and 6 or more, which may be determined based on a relationship with the magnitude of the inverter output.

FIG. 7(*c*) represents a circuit arrangement of the tri-state buffer 81.

In the tri-state buffer 81 according to this embodiment mode, enhancement type FETs (MOS type FETs) 81*a*, 81*b*, 81*c*, and 81*d* are series-connected to each other. Both the FETs 81*a* and 81*b* are p-channel type FETs, whereas the FETs 81*c* and 81*d* are n-channel type FETs. In the p-channel type FET 81*b* and the n-channel type FET 81*c*, the gates thereof are connected to each other; the sources thereof are connected to each other; the gate sides are connected to an input terminal "in" of the tri-state buffer 81; and the source sides thereof are connected to an output terminal "out". The series-connection portion between the FET 81*a* and the FET 81*b* will constitute a complementary type inverter.

The p-channel type FET 81*a* is series-connected between the FET 81*b* and the power supply VDD, and the n-channel type FET 81*d* is series-connected between the FET 81*c* and the ground terminal Vss. An input terminal "sw" is connected to the gate of the FET 81*a*, and an input terminal "sw-" (bar is given above symbol sw in the drawing) is connected to the gate of the FET 81*d*. Either an L-leveled signal or an H-leveled signal, which are opposite to either an H-leveled signal or an L-leveled signal entered to the input terminal sw, is applied to the input terminal sw-. Alternatively, while a single input terminal sw is arranged as the second input terminal of the buffer 8, this input terminal may be connected to the gate of the FET 81*d* and also may be connected via the inverter to the gate of the FET 81*d*.

Also, in FIG. 7(*c*), the signals entered into the gates of the FET 81*a* and the FET 81*b* may be replaced with each other. That is, the input terminal "in" may be connected to the gate of the FET 81*a*, and the input terminal "sw" may be connected to the gate of the FET 81*b*. Similarly, the input signals supplied to the gates of the FET 81*c* and the FET 81*d* may be replaced with each other. That is, the input terminal "sw-" may be connected to the FET 81*c*, and the input terminal "in" may be connected to the FET 81*d*.

In addition to the H-leveled output and the L-leveled output from the FETs 81*b*, and 81*c* which constitute the inverter, both the FETs 81*a* and 81*d* are used to be brought into the high impedance state as the third state. In other words, when the input terminal sw is at the H level, the p-channel type FET 81*a* is turned OFF, and in this case, since the input terminal sw- is at the opposite L-level, the n-channel type FET 81*d* is also turned OFF. As a consequence, the tri-state buffer 81 is brought into the high impedance state, and the current consumed from the power supply terminal VDD is stopped.

As a result, in this embodiment mode, the respective tri-state buffers 81 are brought into the high impedance states by setting the input terminal sw of the buffer 8 to an H-level (input terminal sw- is set to L-level) which is connected to a terminal which is not used out of the output terminals SO, SO1, SO2, and the input terminal SI2. As a result, the current consumed by the buffer 8 can be reduced.

Conversely, when the output terminals SO, SO1, SO2, or the input terminal SI2 is used, the input terminal sw of the buffer 8 connected thereto is set to an L-level (input terminal sw- is set to an H-level), so that the respective tri-state buffer 81 are brought into active states, and therefore are used as the normal inverter.

It should also be noted that the input terminal sw of the buffers 8 connected to the input terminal SI2 and the output terminals SO1 and SO2 may be provided as separate terminals, respectively. Also, all of those terminals, or any two of these terminals may be provided as a common terminal (for example, input terminals sw of both buffers 8 connected for terminals SO1 and SI2).

Depending upon the way to use the thermal head driving integrated circuit 0, the input terminals sw of the respective buffers 8, or the commonly connected input terminal sw may be properly selected by the external input, the fuse trimming, the mask option and the like. For example, when both the shift registers 41 and 42 are connected in the series connection manner, or the parallel connection manner by connecting/disconnecting the switch circuit SWC, either the H-leveled signal or the L-leveled signal is selectively supplied from an external input to the input terminal sw of the buffer 8. When the shift registers 41 and 42 are used in the series mode, since both the output terminal SO1 and the input terminal SI2 are not used, the H-leveled signal is supplied to the input terminal sw of the corresponding buffer 8. When the shift registers 41 and 42 are used in the parallel mode, since the input terminal SI2 need not be used, the L-leveled signal is supplied to the input terminal sw of the corresponding buffer 8.

On the other hand, similar to the operation as explained in FIG. 5, the input terminal sw may be fixed to either the H-level or the L-level by the fuse trimming in the case that when this thermal head driving integrated circuit is mounted on the thermal head, the use mode of the shift registers is determined as either the series mode or the parallel mode, and thereafter the connection state is not changed. Alternately, in the case that a decision is made as to whether or not the input terminal SI1 of another thermal head driving integrated circuit is series-connected to the output terminal SO2, and thereafter, the connection state is not changed.

Note that when the output terminals SO1 and SO2 may be used while the data is set, the H level or the L level may be preferably changed in response to the external input.

Next, still another embodiment of the present invention will now be described.

In this embodiment, a pad of the output terminal SO1 of the front-staged shift register 41 and a pad of the input terminal SI2 of the rear-staged shift register 42 are commonly used, and a selection is made between the use of the output terminal SO1 and the use of the input terminal SI2. Furthermore, in this embodiment mode, the decision as to whether or not the input terminal SI2 is used may be determined in connection with either the parallel use of the shift registers 41 and 42 or the series use of the shift registers 41 and 42. As consequence, the common pad (common terminal) 91 may be switched to be used with the output terminal SO1, or the input terminal SI2 in conjunction with the switch means for selecting connection/disconnection of the shift registers 41 and 42.

Figure 8:
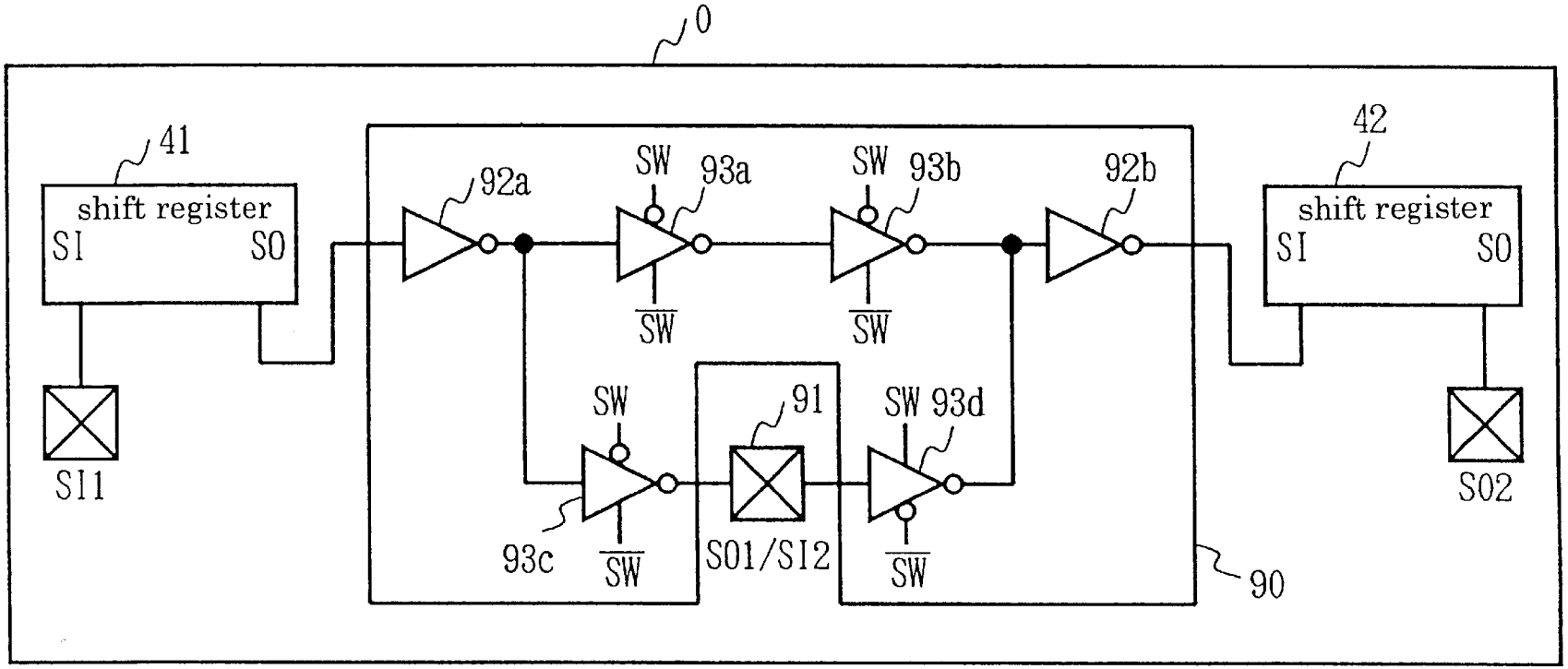
FIG. 8 is a circuit arrangement diagram for indicating another embodiment mode of the thermal head driving integrated circuit according to the present invention.

FIG. 8 represents a thermal head driving integrated circuit "0" according to this embodiment, in which a switch means and a selecting means are employed. It should be noted that the same reference numerals shown in other drawings will be employed as those for denoting the same in this embodiment of FIG. 8.

As shown in FIG. 8, a switch circuit SWC90 in connected between the output unit SO of the front-staged shift register 41 (output terminal of last-staged D-FF) and the input unit SI of the rear-stages shift register 42 (input terminal of first-staged D-FF). The SWC circuit SWC90 may function as a switch means for connecting/disconnecting the two stages of shift register 41 and 42 series-connected in the front and rear stages, and also may function as a selecting means for selecting as to whether the common pad 91 is used as the output terminal SO1, or the input terminal SI2.

The switch circuit SWC90 is provided with two inverters 92*a,* 92*b,* and also four tri-state inverters 93*a* to 93*d* (typically, indicated as reference numeral 93).

In the switch circuit SWC 90, the inverter 92*a,* the tri-state inverter 93*a,* the tri-state inverter 93*b,* and the inverter 92*b* are series-arranged in this order. Among these elements, the tri-state inverters 93*a* and 93*b* function as the switch means. The input terminal of the inverter 92*a* is connected to the output unit SO of the front-staged shift register 41 (output of final-staged D-FF), and the output terminal of the inverter 92*b* is connected to the input unit SI of the rear-staged shift register 42 (input of first-staged D-FF).

Also, the inverters 92*a* and 92*b,* and the tri-state inverters 93*c* and 93*d* function as the selecting means. The input terminal of the tri-state inverter 93*c* is connected to the output terminal of the inverter 92*a,* and the output terminal of the tri-state inverter 93*c* is connected to the common pad 91. Also, the input terminal of the tri-state inverter 93*d* is connected to the common pad 91, and the output terminal of this tri-state inverter 93*d* is connected to the input terminal of the inverter 92*b.*

The internal circuit arrangement of each of the tri-state inverters 93*a,* 93*b* and 93*c* is identical to that of the tri-state inverter 81 shown in FIG. 7(*c*). The internal circuit arrangement of the tri-state inverter 93*d* is identical to that shown in FIG. 7(*c*) except that the input terminal sw and the input terminal sw- are replaced by each other. In other words, in the tri-state inverter 93*d,* the gate of the p-channel FET 81*a* is connected to the input terminal sw-, and the gate of the n-channel FET is connected to the input therminal sw. As a result, the tri-state inverters 93*a,* 93*b* and 93*c* become active low (may function as inverters at L level, and under high impedance state at H level) with respect to the input terminal sw, and also the tri-state inverter 93*d* becomes active high (may function as inverter at H level, and under high impedance state at L level) with respect to the input terminal sw.

Similar to the explanation in FIG. 7(*c*), each of the tri-state inverters 93 may be arranged in such a manner that one input terminal sw is arranged as the second input terminal, this input terminal is connected to the gate of the FET 81*a* (FET 81*d* n case of 93*d*), and also is connected via an inverter to the gate of the FET 81*d* (FET 81*a* in case of 93*d*).

The input terminals sw and the input terminals sw- of the respective tri-state inverters 93*a,* 93*b,* 93*c,* and 93*d* may be provided as separate terminals. Also, all of these terminals may be employed as a common terminal. Furthermore, while the tri-state inverters 93*a* and 93*b* used as the switch means are used as a common terminal, the tri-state inverters 93*c* and 93*d* functioning as the selecting means may be used as a common terminal.

Depending upon the way to use the thermal head driving integrated circuit 0, the input terminals sw (sw-), or the commonly connected input terminal sw may be properly selected by the external input, the fuse trimming, the mask option and the like. For example, when both the shift registers 41 and 42 are connected in the series connection manner, or the parallel connection manner by connecting/disconnecting the switch circuit swc90, either the H-leveled signal or the L-leveled signal is selectively supplied from an external input to the input terminal sw. As previously explained with reference to FIG. 5, the input terminal sw may be fixed to the H level, or the L level in the case that when this thermal head driving integrated circuit is mounted on the thermal head, the use mode of the shift registers is determined as either the series mode or the parallel mode, and thereafter the connection state is not changed.

A description will now be made of change operations of connection states by the switch circuit SWC90 with the above-explained circuit arrangement.

Since when the input terminal sw is set to an L-level, since the tri-state inverters 93*a* and 93*b* are brought into the active states, the front-staged shift register 41 and the rear-staged shift register 42 are connected in series via the switch circuit SWC90. In such a case that both the shift registers 41 and 42 are series-connected to each other, since these shift registers are used to accept the 128-bit data, the input terminal SI2 for accepting the 64-bit data is not used. As a result, in the switch circuit SWC90, when the input terminal sw is at an L-level, the tri-state inverter 93*d* connected to the selection pad 91 is brought into the high impedance state in conjunction with the series connection between both the shift registers 41 and 42, and this input terminal is not used as the input terminal SI2. On the other hand, when the input terminal sw is set to an L-level, the tri-state inverter 93*c* becomes active, and the output unit SO of the shift register 41 is connected via the inverter 92*a* and the tri-state buffer 93*c* to the selection pad 91, so that the selection pad 91 is used as the output unit SO1.

In other words, when the thermal head driving integrated circuit 0 is used to accept the 128-bit data (when the integrated circuit is connected to switch means), and also when the selection pad 91 is used as the output terminal SO1 while performing the bit test of the front-staged shift register 41 (when selecting means is connected to the output terminal SO1 side), the input terminal sw of the switch circuit swc90 is set to an L-level.

On the other hand, when the input terminal sw is set to an H-level, since the tri-state inverters 93*a* and 93*b* are brought into the high impedance states, the front-staged shift register 41 is disconnected by the SWC90 from the rear-staged shift register 42. In such a case that both the shift registers 41 and 42 are disconnected from each other, and also, these shift registers are used to accept the 64-bit data in the parallel mode, the input terminal SI2 in the rear-shaped is needed. As a result, when the input terminal sw is at an H-level, only the tri-state inverter 93*d* is brought into the active state so that the input unit SI of the rear-staged shift register 42 is connected via the inverter 92*b* and the tri-state inverter 93*d* to the selection pad 91, and this selection pad 91 is used as the SI2. On the other hand, when the input terminal sw is set to an H-level, the tri-state inverter 93*c* connected to the selection pad 91 is brought into a high impedance state, and is not used as the input terminal SI2.

In other words, when the thermal head driving integrated circuit 0 is used to accept the 64-bit data in the two-data systems (when the integrated circuit is connected to the input terminal SI2 side, and separated by the switch means), and also when the pad 91 is used as the input terminal SI2 while performing the bit test of the rear-staged shift register 42 (when selecting means is connected to the input terminal SI2 side), the input terminal sw of the switch circuit SWC90 is set to an H-level.

As previously explained, in accordance with the embodiment mode, the selection pad 91 is selectively switched to the pad for the output terminal SO1 of the front-staged shift register 41 and also to the pad for the input terminal SI2 of the rear-staged shift register 42 in response to the level of the input terminal sw. Thus, since the selection pad 91 is commonly used, the total number of pads can be reduced, and furthermore, the chip size of the thermal head driving integrated circuit can be reduced. Also, the total number of bondings can be reduced, resulting in an improvement of the printing quality.

Moreover, in accordance with this embodiment, mode the input terminal sw (otherwise, input signal level) for selectively series-connecting/disconnecting both the shift registers 41 and 42, and the input terminal sw (otherwise, input signal level) by the selecting means are commonly used by way of the switch means (tri-state inverters 93*a* and 93*b*). As a result, using of the common pad 91 as the output terminal SO1 and using of the common pad 91 as the input terminal SI2 can be selectively switched in conjunction with the connection/disconnection between the shift registers 41 and 42, so that the SWC circuit 90 can be simply controlled.

Also, in accordance with this embodiment mode, since a portion of the selecting means and the switch means are arranged by the tri-state inverter 93, while the tri-state inverters connected to the unused connection system are brought into the high impedance states so as to be disconnected from the power supply voltage VDD, the current consumption thereof is suppressed.

Figure 9:
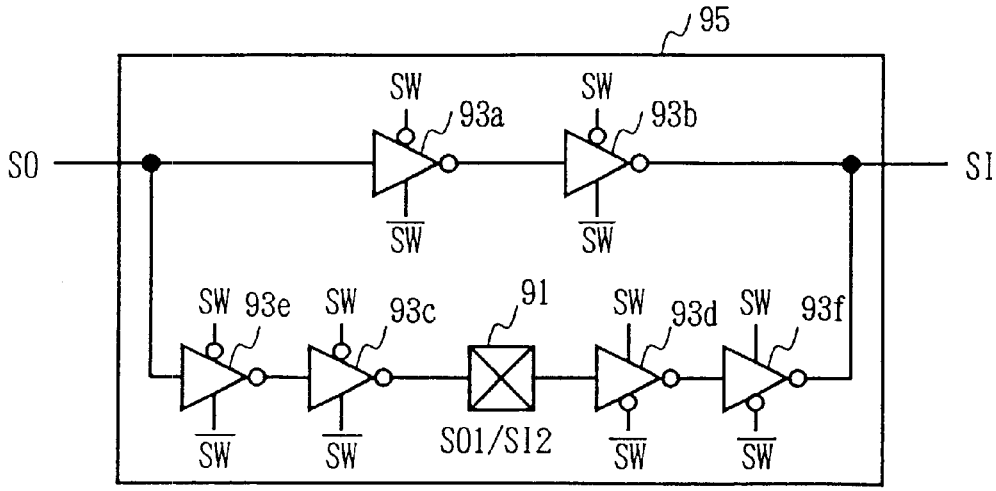
FIG. 9 is a circuit diagram for representing a modification of a switch circuit employed in the thermal head driving integrated circuit according to the present invention.

FIG. 9 represents an arrangement of a modification of the switch circuit SWC90 indicated in FIG. 8. It should be noted that the same reference numerals shown in the switch circuit of FIG. 8 will be employed as those for indicating the same circuit elements of this modification.

In a switch circuit 95 according to the modification shown in FIG. 9, switch means and selecting means are connected in parallel, to which the output unit SO of the front-staged shift register 41 and the input unit SI of the rear-staged shift register 42 are connected, respectively. Then, in this modification, tri-state inverters 93*e* and 93*f* are employed, instead of the inverters 92*a* and 92*b*.

In accordance with the switch circuit 95 in this modification, in comparison with the switch circuit 90 shown in FIG. 8, since both the shift registers 41 and 42 are connected not via the inverters 92*a* and 92*b*, but only the switch means (93*a*, 93*b*) to each other, a signal delay between both the shift registers 41 and 42 can be reduced.

Also, since the tri-state inverters 93*e* and 93*f* are employed instead of the inverters 92*a* and 92*b*, the current consumed in this switch circuit 95 may be further reduced, as compared with that of the switch circuit 90 shown in FIG. 8. In other words, as the circuit elements through which the currents flow in the case that the switch terminal sw is set to the L-level, there are 5 elements in the case of the switch circuit 90, namely the inverters 92*a*, 92*b* and the tri-state inverters 93*a*, 93*b*, 93*c*. In contrast, in the switch circuit 95 of this modification, there are 4 elements, namely the tri-state inverters 93*a*, 93*b*, 93*c*, 93*e*. In other words it is possible to reduce such a current consumed by one circuit element. On the other hand, as the circuit elements through which the current flows in the case that the switch terminal sw is set to the H-level, there are 3 elements in the case of the switch circuit 90, namely the inserters 92*a*, 92*b* and the tri-state inverter 93*d*. In contrast, in the switch circuit 95 of this modification, there are 2 elements, namely the tri-state inverters 93*d*, and 93*f*. Also, in this case, it is possible to reduce such a current consumed by one circuit element.

Figure 10:
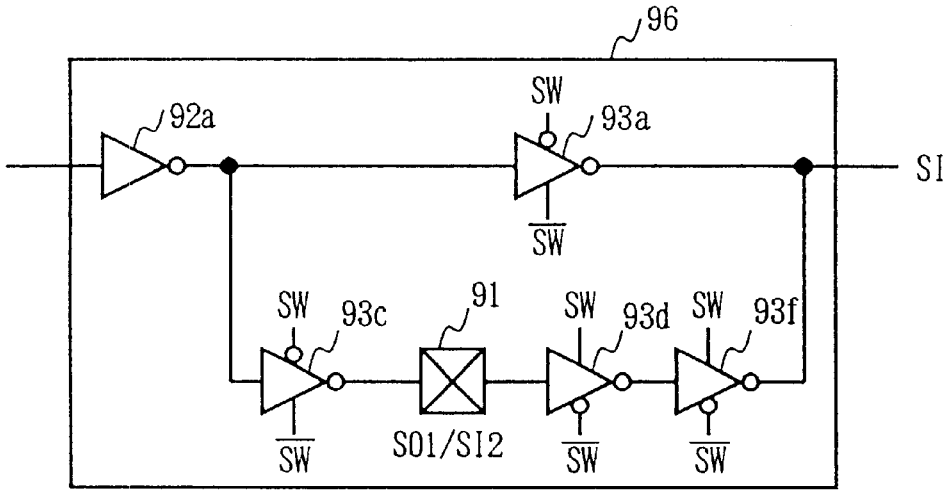
FIG. 10 is a circuit diagram for representing another modification of the switch circuit employed in the thermal head driving integrated circuit according to the present invention.

FIG. 10 represents an arrangement of a further modification of the switch circuit SWC 90 indicated in FIG. 8. It should be noted that the same reference numerals shown in the switch circuit of FIGS. 8 and 9 will be employed as those for indicating the same circuit elements of this modification.

In a switch circuit 96 shown in FIG. 10, the input of the inverter 92*a* is connected to the output unit SO of the front-staged shift register 41, and this inverter 92 is commonly used by both the switch means and the selecting means.

In other words, the input of the tri-state inverter 93*a* is connected to the output of the inverter 92*a*, the output of this tri-state inverter 93*a* is connected to the input unit SI of the rear-staged shift register 42, and also both the inverter 92*a* and the tri-state inverter 93*a* constitute the switch means.

On the other hand, the input of the tri-state inverter 93*c* is connected to the output of the inverter 92, while the output thereof is connected to the common pad 91. Then, the tri-state inverters 93*d* and 93*f* are connected in series, where the input side is connected to the common pad 91 while the output side is connected to the input S1 of the rear-staged shift register. The inverter 92*a* and the tri-state inverters 93*c*, 93*d* and 93*f* constitute the selecting means, While the switch circuit 96 is arranged in the above-explained circuit arrangement, in comparison with the switch circuit 90 shown in FIG. 8, since both the shift registers 41 and 42 are connected not via the tri-state inverter 93*b* and the inverter 92*b*, but via only the switch means (93*a*, 93*b*) to each other, a signal delay between both the shift registers 41 and 42 can be reduced.

Also, the current consumed in this switch circuit 96 may be further reduced, as compared with that of the switch circuit 90 shown in FIG. 8. In other words, as the circuit elements through which the current flow in the case that the switch terminal sw is set to the L-level, there are 3 elements of the inverter 92*a,* and the tri-state inverters 93*a* and 93*c,* so that the currents consumed by the 2 elements can be reduced, as compared with that of the switch circuit 90 of FIG. 8. On the other hand, as the circuit elements through which the currents flow in the case that the switch terminal sw is set to the H-level, there are 3 elements of the inverter 92*a,* and the tri-state inverters 93*d* and 93*f,* so that the currents consumed by the 2 elements can be reduced, as compared with that of the switch circuit 90 of FIG. 8.

Furthermore, in accordance with the switch circuit 96 of this modification, the total number of elements (inverters and tri-state inverters) which constitute the switch circuit is merely 5 elements smaller than those of the switch circuits 90 and 95 shown in FIG. 8 and FIG. 9 by 1 element.

As previously described, in accordance with the present invention, in the thermal head driving integrated circuit, the switching means is interposed between the two stages of separate shift registers in the front and rear stages, and then this switching means can selectively connect/disconnect both the shift registers. When the high speed printing operation is required, the two stages of shift registers in the front and rear stages are disconnected from each other, and then the data signal is entered to both the shift registers at the same time. Conversely, when none of such a high speed printing operation is required, the two stages of shift registers in the front and rear stages are internally connected to each other. As a result, it is possible to avoid lowering of the data transfer speed caused by the stray capacitance and the like.

Also, according to the present invention, in the thermal head driving integrated circuit, since the output terminal of the front-staged shift register and the input terminal of the rear-staged shift register are not separately provided, but one common terminal is selectively used by the selecting means, the total number of terminals can be reduced. The semiconductor chip can be made compact. Also, since the total number of bonding wire is reduced, the quality can be improved.

In accordance with the present invention, since the buffer circuit can be disconnected from the buffer circuit, this buffer circuit which is connected to a terminal which is not used in some cases such as the output terminal of the front-staged shift register or the input terminal of the rear-staged shift register in the case that, for example, two stages of shift registers are series-connected to each other, the power consumption of this buffer can be suppressed while it is not used.

Furthermore, in the thermal head driving integrated circuit according to the present invention, since the switch means is arranged as the intermediate portion between both the two stages of separate shift registers in the front and rear stages, the input terminal of the rear-staged shift register can be positioned in the vicinity of the rear-staged shift register, and the wiring distances of both the input terminals of the shift registers can be made substantially equal to each other. Also, since the selecting means is also arranged between both the shift registers, the wiring distances of both the input terminals of the shift registers can be made substantially equal to each other. Also, since the wiring distances of the input terminals can be made substantially equal to each other, the signal timing can be made equal to each other, so that the characteristic of the thermal head with respect to the high speed printing operation can be improved.

What is claimed is:

1. A thermal head driving integrated circuit for controlling energizing of a heating resistive element in response to a data signal, comprising:

a data input terminal for receiving data signals in a serial manner;

a data output terminal for outputting the data signals;

a driver circuit having at least two shift registers series-arranged in front and rear stages for sequentially transferring the data signals supplied thereto in a serial manner to store the transferred data signals so that the stored data signals may be read out in a batch mode to drive a plurality of heating resistive elements; and switch means interposed between the data input terminal and the data output terminal with respect to the front-staged shift register, interposed between the data input terminal and the data output terminal with respect to the rear-staged shift register, and interposed between an output terminal of the front-staged shift register and an input terminal of the rear-staged shift register to serially connect the front-staged shift register and the rear-staged shift register;

wherein the switch means selectively serially connects and disconnects the front-staged shift register and the rear-staged shift register to and from each other.

2. A thermal head driving integrated circuit as claimed in claim 1; wherein the shift registers, the driver circuit, and the switch means are formed on a semiconductor chip having an elongated shape in an integrated circuit form, output terminals of a driver side of the chip, which are connected to externally provided heating resistive elements, are arranged along a first long edge side of the semiconductor chip, and the data input terminal, the data output terminal, a power supply terminal, a ground terminal, and control terminals are arranged along a second long edge side of the semiconductor chip opposite the first long edge side.

3. A thermal head driving integrated circuit as claimed in claim 1 or claim 2; wherein the output terminals of the driver side of the chip, which are connected to the externally provided respective heating resistive elements, are arranged in a staggered manner so that the terminals can be accommodated in a smaller space.

4. A thermal head driving integrated circuit as claimed in claim 1 or claim 2; wherein the shift registers, the driver circuit, and the switch means are formed on a semiconductor chip having an elongated shape in an integrated circuit form, and ground terminals are arranged in an array along a center of the semiconductor chip.

5. A thermal head driving integrated circuit as claimed in claim 1; wherein the switch means is arranged between the front-staged shift register and the rear-staged shift register.

6. A thermal head driving integrated circuit for controlling energizing of a heating resistive element in response to a data signal, comprising:

a driver circuit having at least two shift registers series-arranged in front and near stages for sequentially transferring data signals supplied thereto in a serial manner to store the transferred data signals so that the stored data signals may be read out in a batch mode to drive a plurality of heating resistive elements;

a data input terminal for inputting the data signal to the front-staged shift register;

a data output terminal for outputting the data signal from the rear-staged shift register;

switch means interposed between an output of the front-staged shift register and an input of the rear-staged shift register for selectively serially connected and disconnecting the shift registers in the front and rear stages to and from each other;

a common terminal into or from which the data signal may be input or output; and selecting means for selectively connecting the common terminal with either one of the output of the front-staged shift register or the input of the rear-staged shift register.

7. A thermal head driving integrated circuit as claimed in claim 6; wherein the switch means and the selecting means are mutually operated in conjunction with each other such that when the switch means connects the front-staged shift register and the rear-staged shift register in series, the selecting means connects the output of the front-staged shift register to the common terminal.

8. A thermal head driving integrated circuit as claimed in claim 6 or claim 7; wherein the switch means and the selecting means are arranged between the front-staged shift register and the rear-staged shift register.

9. A thermal head driving integrated circuit for controlling energizing of a heating resistive element in response to a data signal, comprising:

one or more shift registers series-arranged in front and rear stages for sequentially transferring data signals supplied thereto in a serial signal manner to store the transferred data signals;

a driver circuit for reading out the data signals stored in the shift registers in a batch mode so as to drive a plurality of heating resistive elements;

a data input terminal and a data output terminal for each of the shift registers, for supplying the data signal to each of the shift registers;

buffer circuits for connecting the shift registers to a respective data input terminal and a respective data output terminal; and connecting/disconnecting means for selectively disconnecting a respective buffer circuit from a power supply used to provide a bias voltage to components of the integrated circuit when the buffer circuit is connected to one of the data input and data output terminals which is not being used.

10. A thermal head driving integrated circuit as claimed in claim 6 or claim 9; wherein at least one of the switch means, the selecting means and the connecting/disconnecting means comprises either a tri-state buffer or a tri-state inverter.

11. A circuit for driving a thermal print head, comprising: an input terminal for receiving print data; a driver circuit having at least two shift registers including a front shift register and a rear shift register for sequentially transferring the print data supplied thereto and an output circuit for outputting the print data to heating resistive elements in a parallel manner; and switch means interposed between an output of the front shift register and an input of the rear shift register to selectively serially connect the front and rear shift registers to form a single shift register.

12. A circuit for driving a thermal print head according to claim 11; wherein the switch means comprises a logic circuit.

13. A circuit for driving a thermal print head according to claim 11; further comprising an output terminal; wherein the switch means is further interposed between the input terminal and the output terminal with respect to the front shift register, and between the input terminal and the output terminal with respect to the rear register.

14. A circuit for driving a thermal print head according to claim 13; wherein the switch means includes buffer circuits for connecting the shift registers to a data input terminal and a data output terminal of the integrated circuit; and further comprising means for selectively disconnecting a respective buffer circuit from a power supply used to provide a bias voltage to components of the integrated circuit when the buffer circuit is connected to a data input terminal or a data output terminal which is not being used due to the state of connection between the front and rear shift registers.

15. A circuit for driving a thermal print head according to claim 11; further comprising a common terminal into or from which the print data may be input or output; and selecting means for selectively connecting the common terminal with either one of an output of the front shift register or an input of the rear shift register.

16. A circuit for driving a thermal print head according to claim 15; wherein the selecting means comprises one of a tri-state buffer or a tri-state inverter.

17. A circuit for driving a thermal print head according to claim 15; wherein the switch means and the selecting means are operated in conjunction with each other so that when the switch means connects the front shift register and the rear shift register in series, the selecting means connects the output of the front shift register to the common terminal.

18. A circuit for driving a thermal print head according to claim 11; further comprising buffer circuits for connecting the shift registers to a data input terminal and a data output terminal of the integrated circuit; and means for selectively disconnecting a respective buffer circuit from a power supply used to provide a bias voltage to components of the integrated circuit when the buffer circuit is connected to a data input terminal or a data output terminal which is not being used due to the state of connection between the front and rear shift registers.

19. A circuit for driving a thermal print head according to claim 18; wherein the means for selectively disconnecting a respective buffer circuit from a power supply comprises one of a tri-state buffer or a tri-state inverter.

20. A circuit for driving a thermal print head according to claim 11; wherein the switch means comprises one of a tri-state buffer or a tri-state inverter.

* * * * *